US006471187B1

(12) United States Patent
Dubé et al.

(10) Patent No.: US 6,471,187 B1
(45) Date of Patent: Oct. 29, 2002

(54) APPARATUS FOR LIFTING OR SUPPORTING MODULAR FURNITURE

(76) Inventors: Jean-Guy Dubé , 147 Isabelle Street, Hull (CA), J8Y 5H6; Kamal Roy Nandram, 203 Balmoran Pl., Ottawa, Ontario (CA), K1H 1B2

( * ) Notice: Subject to any disclaimer, the term of this patent is extended or adjusted under 35 U.S.C. 154(b) by 1 days.

(21) Appl. No.: 09/962,187

(22) Filed: Sep. 26, 2001

(30) Foreign Application Priority Data

Sep. 12, 2001 (CA) ..... 2357350

(51) Int. Cl.[7] ..... B66F 3/00

(52) U.S. Cl. ..... 254/134; 254/133 R; 254/137; 254/8 B

(58) Field of Search ..... 254/133 R, 134, 254/131, 8 B, 2 B, 124; 29/273, 271

(56) References Cited

U.S. PATENT DOCUMENTS

| | | | | |
|---|---|---|---|---|
| 4,203,578 A | | 5/1980 | Margueratt | |
| 5,261,643 A | * | 11/1993 | Wurdack | 254/106 |
| 5,299,779 A | | 4/1994 | Collins | |
| 5,385,335 A | | 1/1995 | Wurdack | |
| 5,490,757 A | | 2/1996 | Stratman | |
| 5,529,287 A | * | 6/1996 | Pelosi | 254/129 |
| 5,628,610 A | * | 5/1997 | Stratman | 414/680 |
| 5,806,836 A | | 9/1998 | Wilson | |
| 5,855,360 A | * | 1/1999 | Wurdack | 254/100 |
| 5,947,449 A | * | 9/1999 | Dube | 254/134 |
| 6,113,044 A | * | 9/2000 | Stratman | 248/200.42 |

FOREIGN PATENT DOCUMENTS

| | | |
|---|---|---|
| CA | 2277153 | 7/1998 |
| GB | 1305902 | 2/1973 |

* cited by examiner

*Primary Examiner*—Joseph J. Hail, III
*Assistant Examiner*—Daniel Shanley

(57) ABSTRACT

Apparatus for lifting or supporting modular furniture panels having accessory hanging tracks with apertures, including a support having an upright shaft and a lifting jig movable on the shaft. The lifting jig has a support plate for engaging the underside of a panel, and an angle bracket above the support plate has a series of undercut hooks for engagement with apertures of a hanging track so as to positively locate the jig in relation to the panel. The angle bracket has an inner flange parallel to and attached to a front face of the lifting jig and an outer flange projecting perpendicularly from the front face and having the hooks. The inner flange is provided with horizontal slots which are engageable by screws which extend into said front face of the lifting jig and which allow lateral adjustment of the bracket relative to the lifting jig. The slots have enlarged end portions which allow the bracket to be removed from the lifting jig upon loosening of the screws, so that the bracket may removed and repositioned in inverted position without removal of the screws; in inverted position the hooks can directly engage the hanging tracks.

8 Claims, 5 Drawing Sheets

APPARATUS FOR LIFTING OR SUPPORTING MODULAR FURNITURE

BACKGROUND OF THE INVENTION

1. Field of the Invention

The present invention relates to means for lifting or supporting modular furniture of the type used in offices. The most common use for the apparatus is to allow access to an office floor, e.g. for replacement of carpets or other flooring, including panels of raised flooring, without the need to remove the furniture from the office. However, there may also be a need to lift panels to modify base portions of the panels.

2. Prior Art

Modern offices are often provided with so-called "modular furniture", which comprises an arrangement of panels interconnected at angles to form office dividers, and which have so-called "hanging tracks" used to support desks, bookshelves, and other necessary office equipment. These hanging tracks are vertical metal strips, usually located at the edges of the panels, having a series of undercut slots from which special hangers, with suitable hooks, can be suspended. Generally, these hanging tracks are aligned with feet which support the panels, and which usually provide the only contact between the floor and the modular furniture.

The fact that quite a number of such panels, and their associated desks and shelves, are connected together makes it time consuming and costly to dismantle this furniture and remove it from an office to allow carpeting or other flooring to be replaced. Accordingly, apparatus has been designed and used which will allow the panels and associated furniture to be temporarily raised so that new flooring can be placed underneath. Apparatus of this kind is described, for example, in:

- U.S. Pat. No. 5,261,643, issued Nov. 16, 1993 to Wurdack;
- U.S. Pat. No. 5,299,779, issued Apr. 5, 1994 to Collins;
- U.S. Pat. No. 5,385,335, issued Jan. 31, 1995 to Wurdack;
- U.S. Pat. No. 5,490,757, issued Feb. 13, 1996 to Stratman;
- U.S. Pat. No. 5,529,287, issued Jun. 25, 1996 to Pelosi, Jr. et al.; and
- U.S. Pat. No. 5,628,610, issued May 13, 1997 to Stratman et al.

Several of these patents use lifting jigs which have plates with a series of hooks for engaging the hanging tracks of the panels; for example the Wurdack patents, and those of Stratman and Pelosi et al. have this feature. Applicants have found that the arrangements shown in some of these patents tend to lack the desired stability, since they positively engage only a relatively short length of the hanging track, typically 2 to 5 inches of the hanging track.

Another drawback of these arrangements is that in some makes of panel, notably those made by Haworth Inc., the hanging tracks may be dislocated if the panels are lifted in this way.

Our Canadian Patent No.2,223,736, granted Mar. 30, 1999, and corresponding U.S. Pat. No. 5,947,449, issued Sep. 7, 1999, describe a lifting jig suitable for the Haworth type panels, or any such panel which cannot be lifted by their hanging tracks. The jig includes a lower portion having a support plate suitable for engaging the underside of a panel, and an upper, stabilizer portion having a hook with a downwardly facing undercut recess for engaging the bottom of one of the hanging track apertures, with the spacing between the hook and the support plate being adjustable so as to positively lock the jig in relation to the hanging track of the panel.

Other designs of lifting device suitable for Haworth type panels are shown in some recent patents, notably:

- U.S. Pat. No. 5,855,360, issued Jan. 5, 1999 to Wurdack; and
- Can. Pat. Appln. No.2,277,153, published Jul. 16, 1998, and assigned to Shaw Industries Inc.

The Wurdack '360 patent is concerned with a lifting member specifically suitable for the Haworth type panels, and is not readily adaptable to panels which are better lifted by the hanging tracks.

The Shaw Industries Canadian application shows a lifting jig which can have various different attachments depending on the type of panel to be lifted, including platform members which can be used for Haworth type panels, and various hook type arrangements including hook plates which are situated side-by-side for simultaneously lifting the ends of adjacent panels. However, neither the Wurdack U.S. '360 patent, nor the Shaw Industries application, show lifters for Haworth type panels which provide the kind of stability given by our patented design referred to above. In particular, none has a support plate which can be adjusted relative to a downwardly facing hook so that the spacing between the hook and the support plate allows the hook to enter an aperture in a hanging track at one spacing and allows the track to be positively gripped between the support plate and the hook at another spacing.

It is an object of the present invention to provide a lifting jig for lifting office panels which has all the advantages of that of our aforesaid U.S. and Canadian patents, and which is also easily adapted to lifting suitable panels by engagement of hooks with hanging tracks. In the preferred form, the lifting jig can simultaneously engage two hanging tracks at adjacent ends of two panels.

The present invention firstly provides apparatus for lifting or supporting modular furniture which can be used to provide a support plate fitting underneath a panel of the Haworth type and holding such panel more stably than prior art apparatus, in similar manner to the lifting jig of our aforesaid patents, and which can also easily be changed to provide upwardly opening hooks to engage a hanging track like those of the prior art patents.

The invention also provides a lifting jig which can simultaneously support adjacent hanging tracks of two panels while in effect locking the two hanging tracks together.

SUMMARY OF THE INVENTION

The present invention is similar to that of our aforesaid patents in being of the type having a support with a shaft which normally extends vertically and a lifting jig which is movable vertically on the shaft by jacking means, with the lifting jig comprising:

- a main portion having a front face,
- a lower portion having a support plate which projects from below said front face and which is suitable for engaging the underside of a panel, and
- means for adjusting the position of the support plate relative to said main portion.

In accordance with this invention, a hook plate in the form of an angle bracket is mounted on the front face of the lifting jig main portion, the angle bracket having an inner flange parallel to and attached to the said front face and having an outer flange projecting perpendicularly from the said front face and having hook means for engaging in a hanging track of one of the panels so as to positively locate the jig in relation to the panel. The angle bracket has its inner flange provided with several slots which extend normally horizontally, the slots being engageable by screws which extend into said front face to attach the inner flange to the main portion of the lifting jig and which allow lateral adjustment of the bracket relative to the lifting jig and to the support plate. These slots have enlarged portions which allow heads of the screws to pass through these enlarged slot portions so that, with suitable manipulation, the bracket may be removed from the lifting jig upon loosening of the screws but without removal of the screws, and may be repositioned in inverted orientation.

With this arrangement, the angle bracket or hook plate may be fixed by the screws in a first orientation in which the hook means are downwardly open and suitable to secure a hanging track of a panel while the panel is being lifted by the support plate and has parts of its hanging track gripped between the support plate and the hook means, and, upon loosening of the screws, the bracket can be removed from the lifting jig and reattached to the jig by the screws in an inverted orientation in which the hook means are upwardly open for engaging and lifting the hanging track of a panel.

The angle bracket is preferably attached to the front face by at least three screws, and to allow for this re-orientation the screws and slots all have equal spacing between them.

It may be noted that the possibility of fitting the hook bracket in two relatively inverted positions is not available in the prior art Shaw Industries application, since if the Shaw Industries hook plate were to be inverted and inserted into the hanging track it would tend to fall out.

As in our issued patents, the hook means is considerably narrower than the shaft so as to be suitable for engagement in a hanging track, and the spacing between the hook means and the support plate is adjustable so that when the support plate is being used the hook means can enter an aperture of the hanging track at one spacing and the hanging track can be positively gripped between the hook means and the support plate at another spacing.

The bracket may be one of a pair of brackets which each have at least one slot which extends horizontally and which each have a series of the hook means, the slots allowing adjustment of the lateral spacing of the hook means of the two brackets, whereby the hook means can be engaged in the adjacent hanging tracks of two joined panels and provide a means for locking together the adjacent hanging tracks of the two panels. The brackets may include a first, relatively long bracket having two longitudinally spaced apart rows of hooks giving good stability for holding a panel, and a relatively short bracket having a single row of hooks.

BRIEF DESCRIPTION OF THE DRAWINGS

A preferred embodiment of the invention will now be described by way of example with reference to the accompanying drawings, in which.

DETAILED DESCRIPTION

Figure 1:
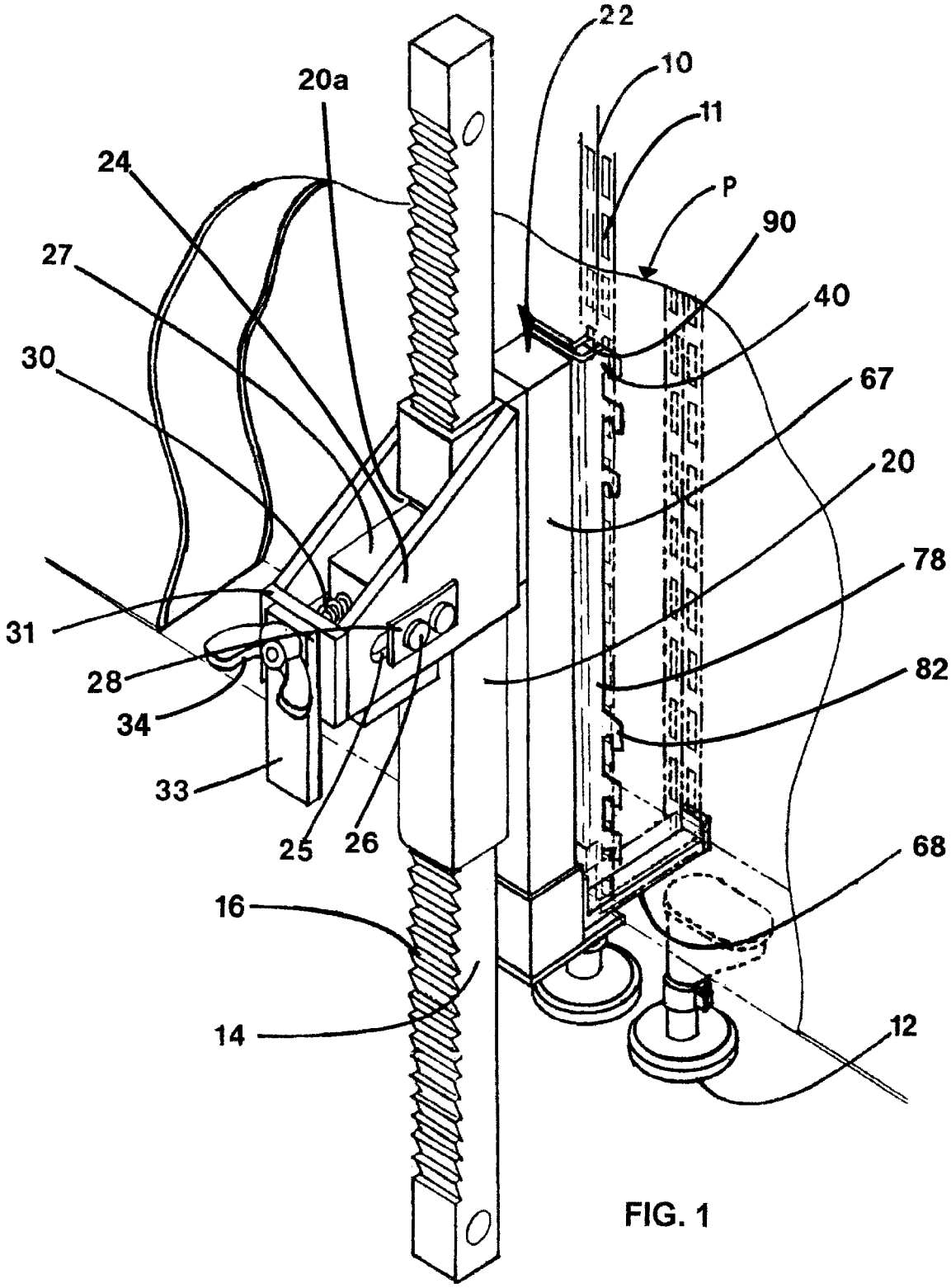
FIG. 1 is a perspective view of lifting apparatus in accordance with the invention, shown supporting a panel.

Referring to FIG. 1, this shows apparatus of the invention being used to lift and support part of a panel P having a hanging track 10 with elongated apertures 11, and having a leg 12 approximately aligned with the hanging track. As will be explained below, this apparatus is one of a series used around a plurality of connected panels. The lifting apparatus has a support including a shaft 14 which normally extends vertically, and which has a square section. The side of the shaft opposite the panel, hereinafter referred to as the rear side, is provided with a rack 16 of ratchet type teeth having substantially horizontal upper surfaces.

Figure 2:
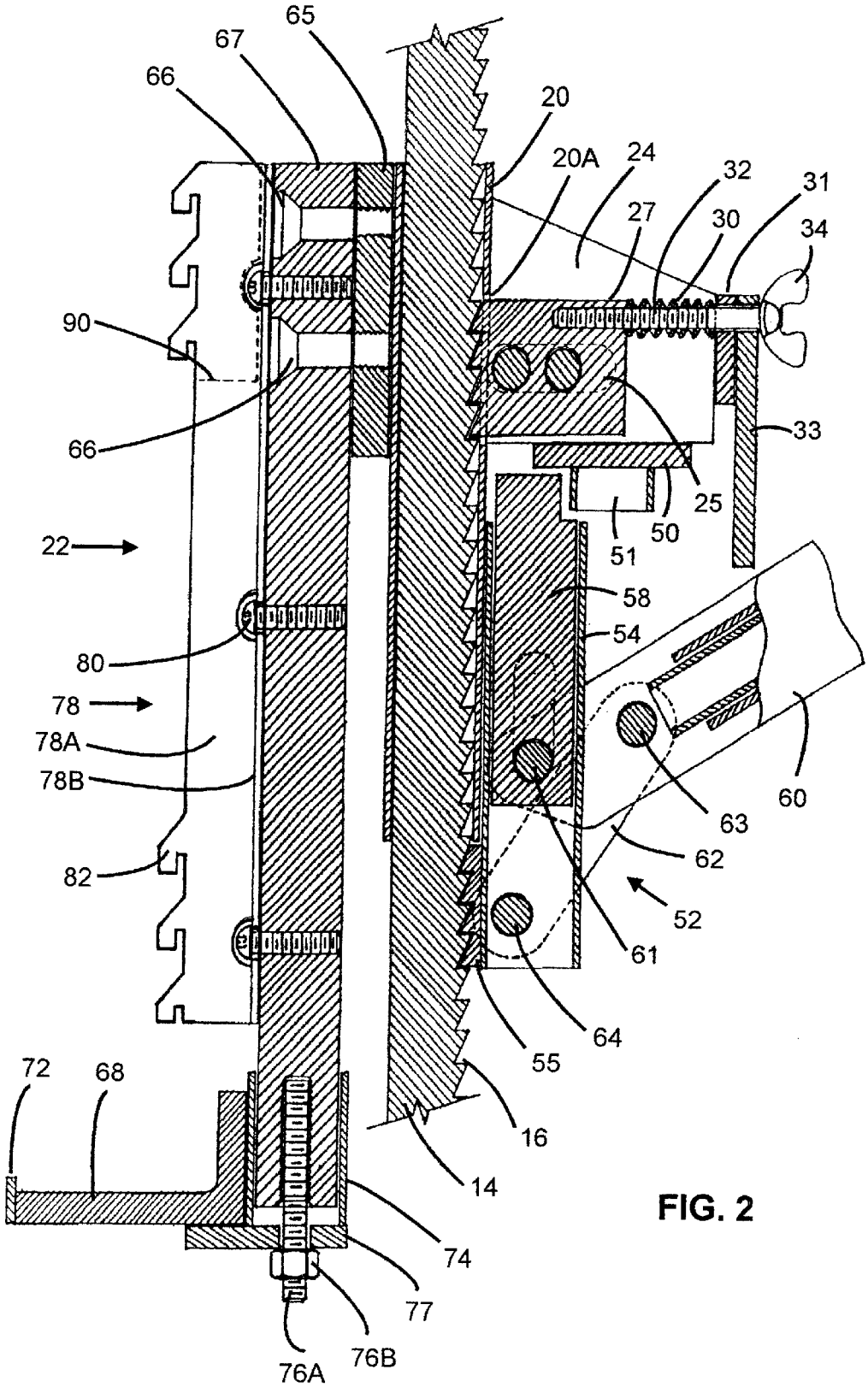
FIG. 2 is a sectional elevation of the main parts of the lifting apparatus of FIG. 1.

Slidable on the shaft 14 is a square-sectioned sleeve 20 which closely surrounds the shaft and which is part of a lifting jig 22. Walls in the form of brackets 24 extending rearwardly from opposite sides of the sleeve 20 have horizontally elongated slots 25 which provide guides for the ends of a pair of slidable horizontal pins 26 which support a pawl 27 located between the walls 24. The outer ends of the pins 26 are connected together outside the walls 24 by spacer plates 28. The pawl 27 is movable within an aperture 20*a* in the rear of the sleeve 20, and has a series of teeth which, as best seen in FIG. 2, are complementary to those of the rack 16 and are caused to engage those teeth by the action of compression spring 30 acting between the rear of the pawl 27 and a back wall 31 joining the rear ends of the walls. The pawl 27 is movable to release the rack by a rod 32 threaded into the pawl and passing along the center of the spring 30 and through apertures in wall 31 and in a pawl retracting lever 33, and which terminates in a pawl retracting wing nut 34. The lever 33 can be manually pivoted away from the wall 31 to pull the rod 32 against the force of the spring 30 so to release the pawl from the rack 16.

As seen in FIG. 2, the lifting jig also includes an abutment plate 50, held by the lower edges of the walls 24, from which projects a short cylindrical tube 51 which provides a jack piston retainer for the movable part or "piston" of removable jacking means 52, as shown in FIG. 2; it can also be used to locate the piston of a hydraulic jack referred to below. The jacking means has a lower, relatively fixed, piston casing 54 the sides of which are supported by a toothed pawl or gripper block 55 capable of engaging on the rack 16 below the sleeve 20. The piston casing slidably holds a piston 58 movable relative to the casing by a jack handle 60. The handle is connected to the lower end of the piston 58 by a cross pin 61 which is movable in vertically elongated slots in the sides of the casing, and the handle 60 also has connection to the casing provided by side links 62 which extend between a holding cross pin 63 near the handle lower end and a similar pin 64 fixed across the lower end of the casing and which also holds the gripper block 55 in the casing. With this arrangement, downwards movement of the handle pushes up the piston 58 and thus raises the whole jig and panel part carried thereby by an amount equivalent to several teeth of the rack 16.

The front side of the sleeve 20 carries a spacer mounting plate 65 to which is attached, by screws 66, a square sectioned main bracket support portion 67 which carries the panel engaging parts of the lifting jig 22 with which this invention is concerned. These parts include a boot support plate 68, and a hook plate 78 in the form of an angle bracket. The support plate 68 has an outer upturned retaining lip 72, and is carried by a boot sleeve 74 having an upwardly open recess fitting onto the lower end of the main bracket support 67. The boot sleeve is adjustably held in place by a screw stud 76A and nut 76B, the screw stud fitting into a threaded bore in the bottom end of support 67. A boot brace plate 77 underlies and reinforces the connection between the plate 68 and the boot sleeve 74.

The angle bracket or hook plate 78 has an outer, projecting flange 78A and also has an inner or base flange 78B, lying at a right angle to flange 78A, and which lies against the front side of the support 67. Flange 78B has three laterally elongated, normally horizontal, slots 79, shown in FIG. 4, which receive screws 80 attaching the flange 78B to the support 67. These slots 79 allow adjustment of the lateral position of the flange 78A relative to the support plate 68. As shown, the flange 78A has a series of undercut hooks 82 which, in the orientation shown in FIGS. 1 and 2, provide downwardly facing recesses which are capable of engaging on the lower edges of panel apertures 11, while the support plate 68 engages the lower edge of the same panel, as shown in FIG. 1. The nut 76B allows the support plate 68 to be raised so that the panel is positively gripped between the hook recesses and the support plate.

Figure 4:
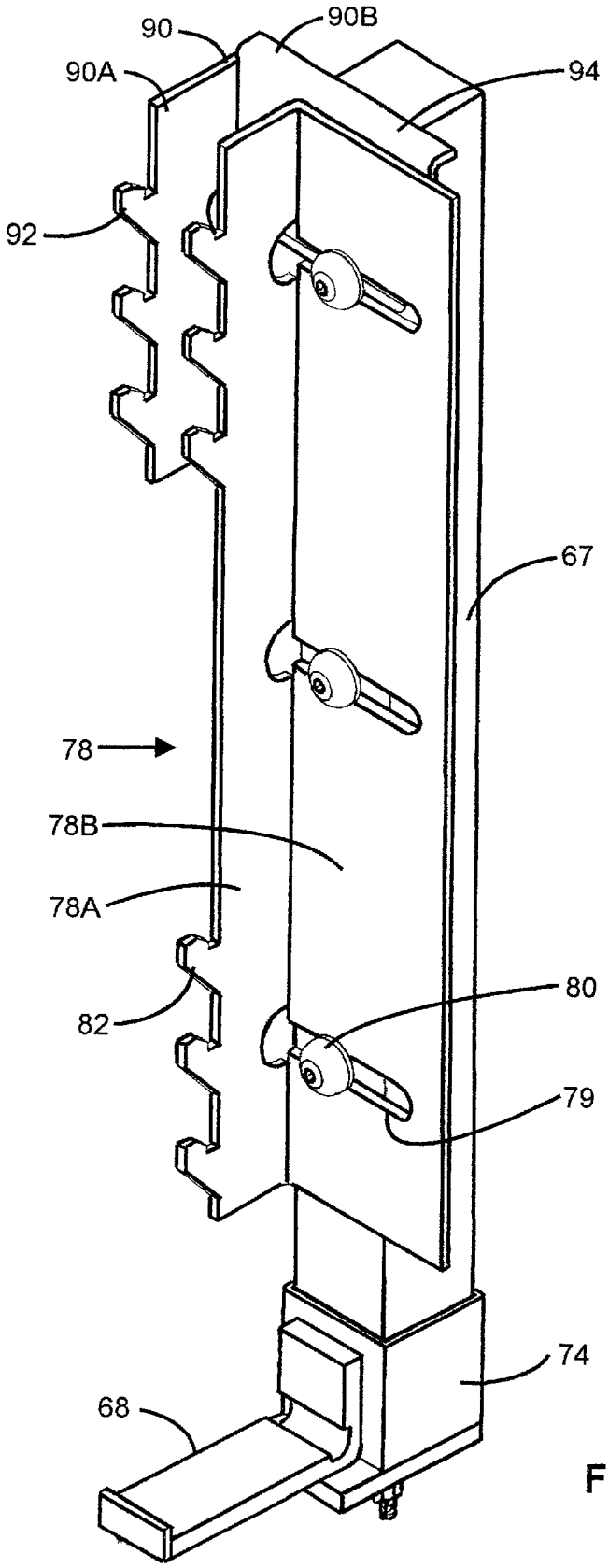
FIG. 4 is a perspective view of parts of the lifting apparatus in the orientation of FIG. 3, and with an auxiliary angle bracket in a first position.
Figure 5:
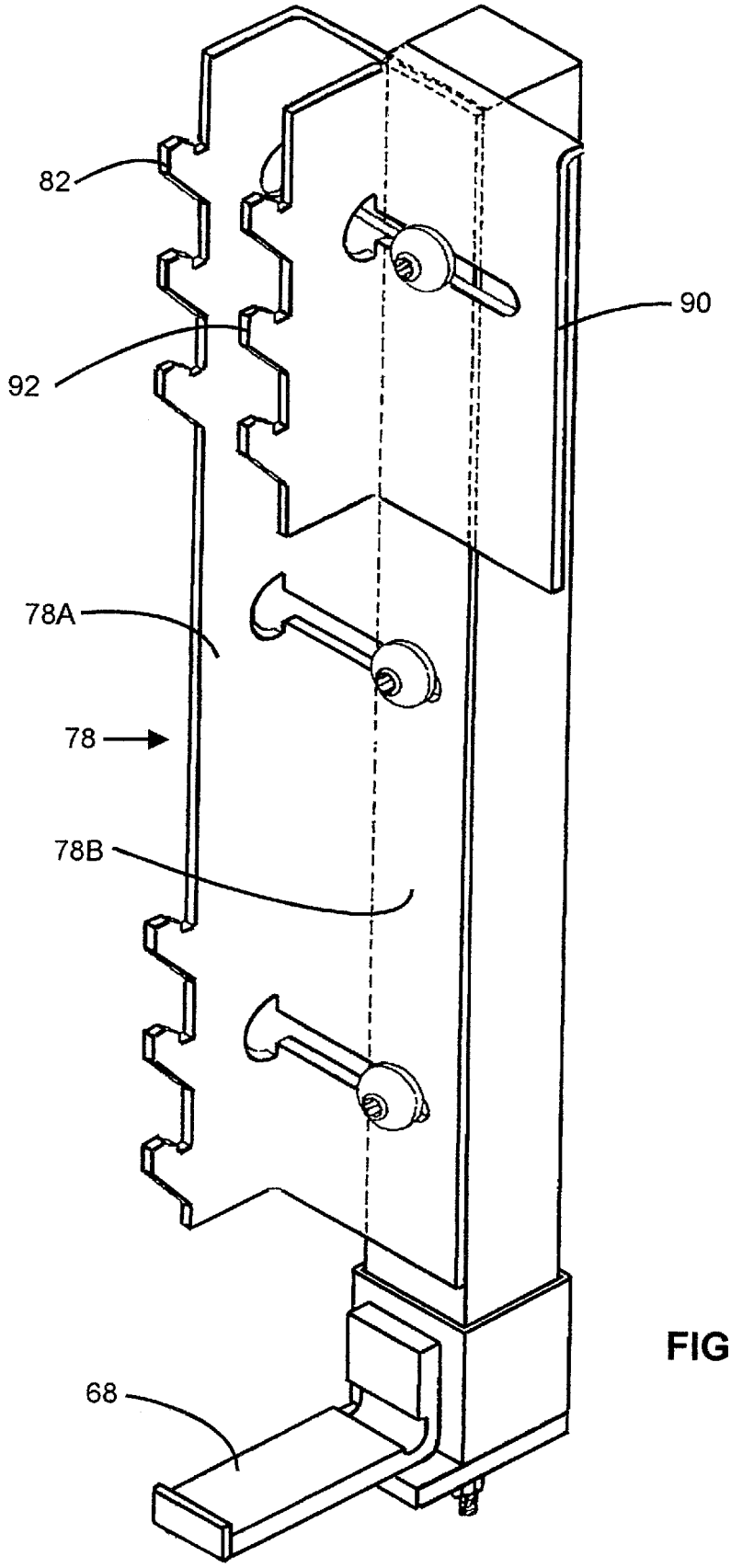
FIG. 5 is a view similar to FIG. 4 but with the auxiliary angle bracket in a different position.

FIGS. 1 and 2 also indicate an auxiliary angle bracket 90 also held by screws 80 to the support portion 67; this auxiliary angle bracket is further described in relation to FIGS. 4 and 5.

The overall length of the hook or angle bracket 78 is about 9 inches, and the hooks 82 are provided in upper and lower groups of three. The distance between the uppermost and lowermost hooks 82 is preferably at least 7 inches, and most preferably at least 8 inches. The distance between the support plate 68 and the uppermost hook 82 is preferably at least 9 inches and in practice slightly more than 11 inches, so that the panel is stably held relative to the lifting jig.

Figure 3:
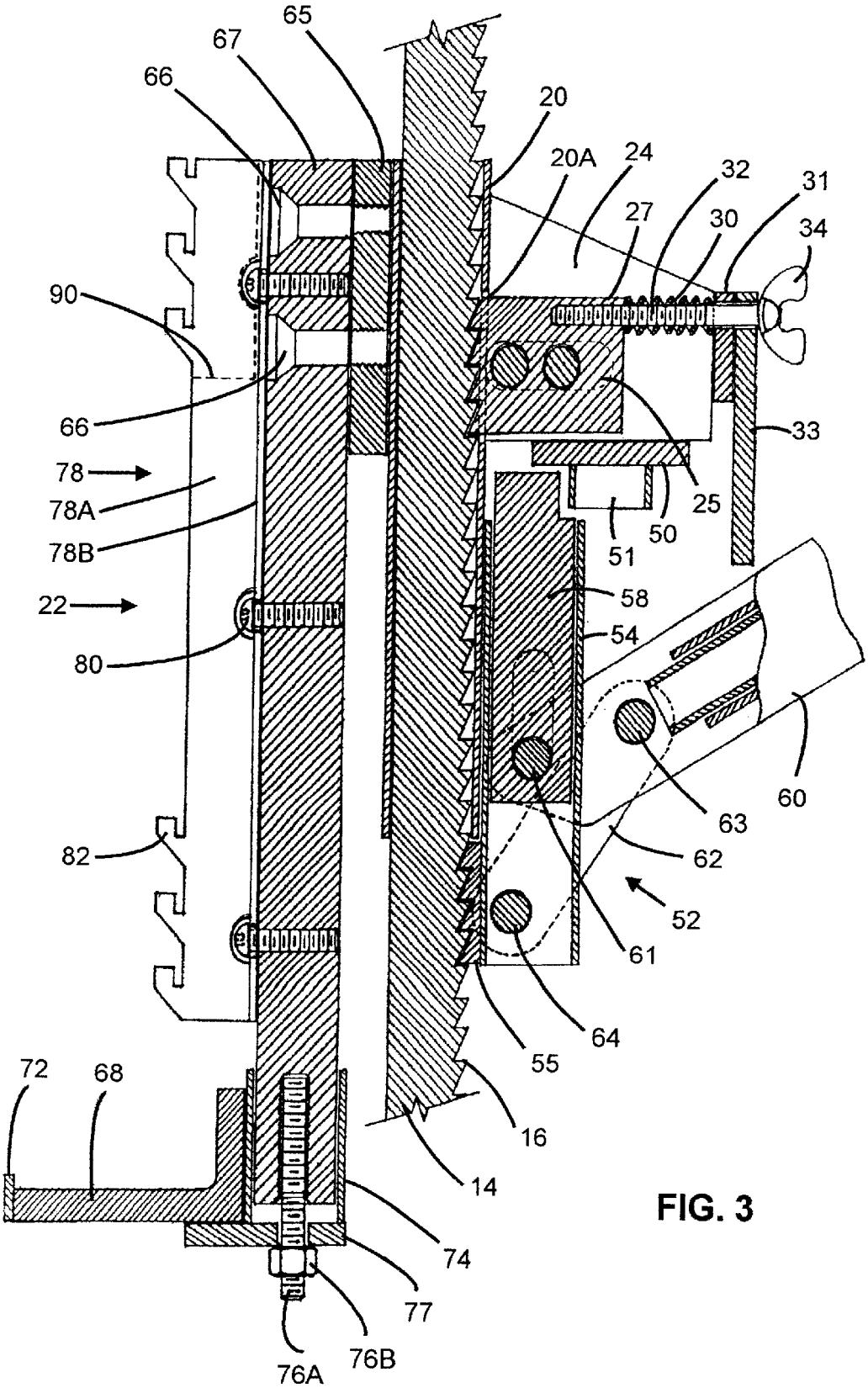
FIG. 3 is a view similar to FIG. 2 but with the angle bracket in an inverted orientation.

FIGS. 3 and 4 show the same parts with the angle bracket 78 differently oriented, and, in FIG. 4, with an auxiliary hook plate or angle bracket 90 having been added. FIG. 4 also illustrates the nature of the slots 79 which allows the easy re-orientation of the angle bracket without removal of screws 80.

As shown in FIG. 4, the slots 79 extend along the inner flange 78B to the outer flange 78A and have enlarged end portions 79A in the outer flange which allow the heads of the screws 80 to pass through the flange 78A, when the screws have been loosened, by the angle bracket 78 being slid in the direction of arrow A. In FIGS. 3 and 4 the angle bracket has been removed from the main jig portion 67 by this means and has been re-attached to the main portion in an inverted orientation, as compared to FIGS. 1 and 2, in which the hooks 82 have upwardly open recesses. The angle bracket can be used in this orientation for hanging tracks of many types of panels which are capable of being lifted by these tracks. In these cases the support plate 68 is not needed and if necessary it can be removed by removal of nut 76B.

FIG. 4 also shows an additional feature of this invention, namely the auxiliary hook plate 90. This is similar to angle bracket 78 in having a series of hooks 92 on an outer flange 90A which projects from an inner flange 90B lying at a right angle to flange 90A, the base flange having normally a horizontal slot similar to the slots 79 and also with an enlarged end opening similar to end openings 79A. The screws 80 pass through the slots in both the angle brackets and lock both of these in place. The upper edge of inner flange 90B has an interned lip 94 which locates against the upper end of support portion 67 to maintain the orientation of the hook plate 90. The lateral position of the flange 90A, and its separation from the flange 78A, is chosen so that the hooks 82 and 92 can engage in the adjacent hanging tracks of two connected panels, and the arrangement acts to lock these panels together during the lifting operation. This arrangement obviates the usual need to provide a locking device between adjacent panel ends.

The auxiliary hook plate 90 is short relative to the hook plate 78 since if it is made of similar length to plate 78 it is difficult to fit it into the adjacent track. The hook plate 90 is only used in the orientation shown in FIG. 4, with the hooks upwardly open, and is not used when the hook plate 78 is inverted.

As shown in FIG. 5, the auxiliary hook plate 90 can, if desired, be positioned inside, rather than outside, the main angle bracket 78.

While purely mechanical jacking means have been described, a hydraulic jack of generally known form may also be used, modified by being provided with a suitable gripper block for engaging the rack. Such a hydraulic jack is shown in our Canadian Patent No.2,223,736, and our U.S. Pat. No. 5,947,449, referred to above.

We claim:

1. Apparatus for lifting or supporting modular furniture, the furniture including panels having accessory hanging tracks, comprising a support having a shaft portion which normally extends vertically, and a lifting jig which is movable vertically on the shaft portion by jacking means, said lifting jig comprising:

a main portion having a front face, a lower portion having a support plate which projects from below said front face and which is suitable for engaging the underside of a panel;

means for adjusting the position of the support plate relative to said main portion;

an angle bracket mounted on said front face, said angle bracket having an inner flange parallel to and attached to said front face and an outer flange projecting perpendicularly from said front face and having hook means considerably narrower than the shaft portion for engaging in a hanging track of one of the panels so as to positively locate the jig in relation to the one panel;

and wherein said bracket has its inner flange provided with several slots which extend normally horizontally, said slots being engageable by screws which extend into said front face to attach the inner flange to said main portion of the lifting jig and which allow lateral adjustment of said bracket relative to the lifting jig, and wherein said slots have enlarged portions located in said outer flange and which allow heads of said screws to pass through these enlarged slot portions so that the bracket may be removed from the lifting jig upon loosening of the screws but without removal of the screws;

whereby said bracket, may removed from the main portion and repositioned in inverted position without removal of said screws, thereby allowing the bracket to have a first orientation in which the hook means are downwardly open and suitable to secure a panel by its hanging track while it is being lifted by said support plate, and a second, inverted orientation wherein said hook means are upwardly open for engaging and lifting a panel by its hanging track.

2. Apparatus according to claim 1, wherein, when the bracket is in its said first orientation, the uppermost of said hook means are spaced above the said support plate by at least 9 inches.

3. Apparatus according to claim 1, wherein the distance between the uppermost and lowermost of said hook means is at least 7 inches.

4. Apparatus for lifting or supporting modular furniture, the furniture including panels having accessory hanging tracks, comprising a support having a shaft portion which normally extends vertically, and a lifting jig which is movable vertically on the shaft portion by jacking means, said lifting jig comprising:

a main portion having a front face, a lower portion having a support plate which projects from below said front face and which is suitable for engaging the underside of a panel;

means for adjusting the position of the support plate relative to said main portion;

an angle bracket mounted on said front face, said angle bracket having an inner flange parallel to and attached to said front face and an outer flange projecting perpendicularly from said front face and having hook means considerably narrower than the shaft portion for engaging in a hanging track of one of the panels so as to positively locate the jig in relation to the one panel;

wherein said bracket has its inner flange provided with several slots which extend normally horizontally, said slots being engageable by screws which extend into said front face to attach the inner flange to said main portion of the lifting jig and which allow lateral adjustment of said bracket relative to the lifting jig, and wherein said slots have enlarged portions which allow heads of said screws to pass through these enlarged slot portions so that the bracket may be removed from the lifting jig upon loosening of the screws but without removal of the screws;

whereby said bracket may removed from the main portion and repositioned in inverted position without removal of said screws, thereby allowing the bracket to have a first orientation in which the hook means are downwardly open and suitable to secure a panel by its hanging track while it is being lifted by said support plate, and a second, inverted orientation wherein said hook means are upwardly open for engaging and lifting a panel by its hanging track;

and wherein an auxiliary bracket is provided having at least one slot which extends normally horizontally and which also has a series of said hook means, said slot allowing adjustment of the spacing of the hook means of the two brackets, whereby the hook means can be engaged in the adjacent hanging tracks of two joined panels.

5. Apparatus according to claim 4, wherein said brackets include a relatively long bracket having two longitudinally spaced apart rows of hooks, and a relatively short bracket having a single row of hooks.

6. Apparatus according to claim 5, wherein each of said brackets has slots with enlarged portions which allow for easy re-orientation of the brackets without removal of said screws.

7. Apparatus for lifting or supporting modular furniture, the furniture including panels having accessory hanging tracks, comprising a support having a shaft portion which normally extends vertically, and a lifting jig which is movable vertically on the shaft portion by jacking means, said lifting jig comprising:

a main portion having a front face, said main portion having a pair of angle brackets, each angle bracket having an inner flange parallel to and attached to said front face of the main portion, and each having an outer flange projecting perpendicularly from said front face and having hook means for engaging in a hanging track of one of the panels so as to positively locate the jig in relation to the panel;

and wherein at least one of the brackets has its inner flange provided with several slots which extend normally horizontally, said slots being engageable by screws which extend into the front face of the main portion to attach the inner flange to said lifting jig and which allow lateral adjustment of one of said brackets relative to the lifting jig and to the other bracket, including adjustment to positions where the outer flanges are close together, whereby said hook means of the two brackets may be used to engage adjacent hanging brackets of two panels which are joined together, and wherein said slots of the one bracket have enlarged portions which allow passage of heads of said screws so that the one bracket may be removed from the lifting jig upon loosening of the screws.

8. Apparatus according to claim 7, wherein said brackets include a long bracket having two longitudinally spaced apart rows of hook means, and a short bracket having a single row of hook means.

* * * * *